United States Patent [19]

Eickhoff et al.

[11] Patent Number: 4,951,464

[45] Date of Patent: Aug. 28, 1990

[54] CARBON BLACK FILTER MEANS FOR A DIESEL ENGINE

[75] Inventors: Heinrich Eickhoff, Rösrath; Elmar Goller, Troisdorf, both of Fed. Rep. of Germany

[73] Assignee: Deutsche Forschungsanstalt fur Luft- und Raumfahrt E.V., Cologne, Fed. Rep. of Germany

[21] Appl. No.: 240,270

[22] Filed: Sep. 2, 1988

[30] Foreign Application Priority Data

Sep. 5, 1987 [DE] Fed. Rep. of Germany ..... 3729861

[51] Int. Cl.[5] ..... F01N 3/02

[52] U.S. Cl. ..... 60/274; 60/303

[58] Field of Search ..... 60/274, 286, 303

[56] References Cited

U.S. PATENT DOCUMENTS 4,571,938 2/1986 Sakurai ..... 60/303

4,574,589 3/1986 Hasegawa ..... 60/286

*Primary Examiner*—Douglas Hart

*Attorney, Agent, or Firm*—Spensley Horn Jubas & Lubitz

[57] ABSTRACT

From the exhaust gas of a Diesel engine, carbon black is filtered out by a ceramic carbon black filter. To regenerate said carbon black filter, it is burned out by means of a burner comprising a swirl nozzle provided with liquid fuel and air. The burner is operated with a super-greased fuel/air mixture, and in the main combustion chamber there is produced a stable flame burning sootlessly. The combustion gases are mixed with the exhaust gases in a transverse flow mixer and the residual fuel amount is burned off in a secondary combustion chamber by air contained in the exhaust gas. Regeneration may take place during the operation of the engine, while the burner flame is not put out by the pulsating engine pressure.

9 Claims, 3 Drawing Sheets

10
11
12
13
14
15
16
17
18
19
20
21
32
33
34
35
36
37
38
39
40
41
42
43
DM

CARBON BLACK FILTER MEANS FOR A DIESEL ENGINE

BACKGROUND OF THE INVENTION

1. Field of the Invention

The invention relates to a carbon black filter means for a Diesel engine such as specified in the precharacterizing part of claim 1.

2. Description of Related Art

Under certain load conditions, Diesel engines produce carbon black which should be filtered out of the exhaust gases. Ceramic carbon black filters adapted to collect black produced during 5 to 8 driving hours are presently tested. Subsequently, upon the use of such filters, a regeneration of the filter is required, said regeneration being performed by burning the black particulate matter at high exhaust gas temperature of at least 600° C. Exhaust temperatures this high are not encountered with Diesel engines because of the high air surplus. For the time being, methods are tried out in which the filter means comprises a burner of its own. Since said burner may not sucessively work against the pulsating exhaust gas pressure of the Diesel engine, tests are made with devices in which, during the regeneration, the filter is bridged via an additional silencer.

It is the object of the invention to provide a carbon black filter means of an in which the regeneration of the filter may be performed during the operation of the Diesel engine without by-passing the motor exhaust gases.

SUMMARY OF THE INVENTION

According to the carbon black filter means of the invention, in the main combustion chamber of the burner, a partial combustion of the introduced fuel is carried out by compulsory air supply, without the formation of carbon black. The unburned portion of fuel is guided together with the fuel gases to the secondary combustion chamber to burn there by means of oxygen contained in the engine exhaust gas. The first combustion takes place by added external air, and only for the secondary combustion, is use made of the motor exhaust gases. The air consumption is relatively low because only an understoichiometric amount of compressed air need be supplied for the main combustion.

Preferably, the atomizer nozzle of the burner is of a ring nozzle type provided with swirl elements, said ring nozzle comprising an annular atomizer tongue along the inside of which sweeps fuel which is atomized by the rotating air current forming a flow cone. In spite of the pulsating counterpressure and in spite of air deficiency, by using such an "air atomizer nozzle", a reliable, stable combustion is ensured. If the total air for the main combustion is supplied at a differential pressure of at least 10 mbar, an intense mixture of fine fuel mist with the combustion air is obtained directly behind the nozzle. Together with the hot gas recirculation caused by the swirl elements of the atomizer nozzle, the resultant combustion is independent of pressure pulsations.

The compressed air fed to the burner may be taken from the compressed air system of the vehicle to be supplied to the atomizer nozzle via a nozzle operated at an overcritical pressure ratio, which means that air in the narrowest nozzle cross section flows at least at sound velocity. Hence, a burner performance independent of the pressure pulsations of the engine exchaust gas may be obtained.

Alternatively, the combustion air may be conveyed by a a positive displacement blower. Again, the air mass flow is either unaffected or only slightly affected by the counterpressure of the Diesel exhaust gas flow, thus ensuring a burner operation uninfluenced by the air mass current and by the burner performance. If the air compressor is coupled with the speed of the Diesel engine and the fuel is also delivered with a rotary pump, the resultant mixture amount control is speed proportional. As the speed of the Diesel engine changes, the burner performance adapts itself to the changed exhaust gas mass flow. By this means, the temperature at the filter may be perfectly maintained during the regeneration.

The burner size is of such a small dimension that it may be easily mounted in the filter housing, and, by a heat exchanger, it may be cooled by engine exhaust gas.

Embodiments of the invention will be explained hereunder in more detail with reference to the drawings in which

DESCRIPTION OF THE PREFERRED EMBODIMENT

Figure 1:
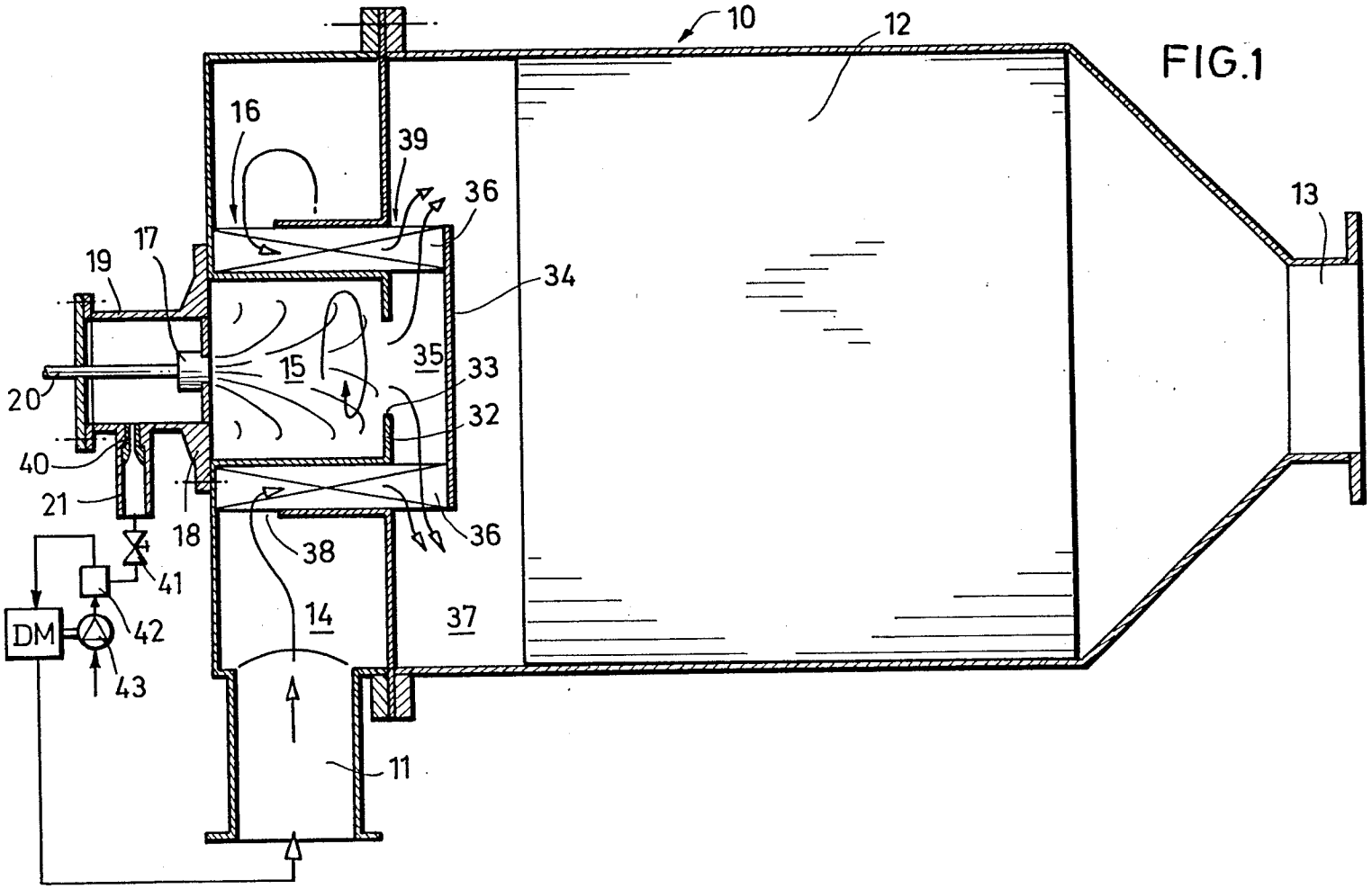
FIG. 1 is a schematic longitudinal section of the filter means.
Figure 2:
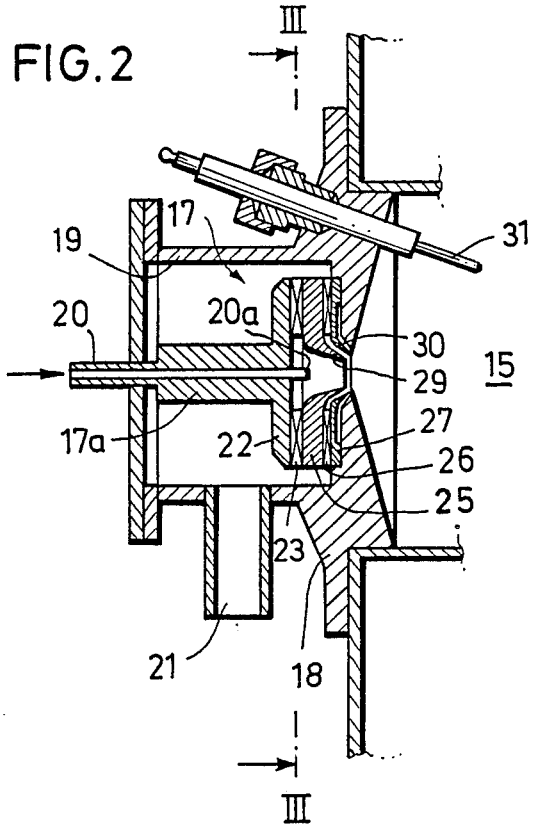
FIG. 2 is a detailed longitudinal section of the atomizer nozzle.
Figure 3:
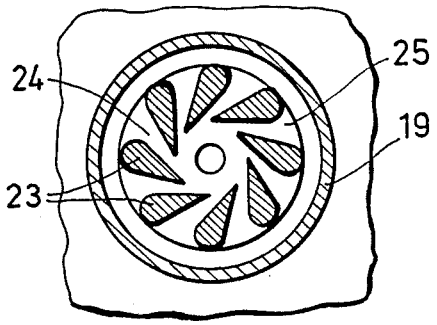
FIG. 3 is a section along line III—III of FIG. 2.

The filter means shown in FIG. 1 comprises a cylindrical housing 10 whose one end is provided with a radial or tangential inlet 11 for the engine exhaust gases and which contains a ceramic filter 12 occupying the total cross section of the housing. Through an outlet piece 13 provided at the other end of the housing 10, engine exhaust gases and fuel gases are discharged. The exhaust gas inlet 11 extends into an annular distribution chamber 14 enclosing the main combustion chamber 15 of burner 16. The atomizer nozzle 17 is fixed to the cover wall 18 of the atomizer housing 19, said cover wall 18 being flanged to the end wall of housing 10 and confining the main combustion chamber 15. Further, the nozzle housing 19 contains an air inlet 21 through which compressed air is pressed into the interior of the nozzle housing. As evident from FIG. 2, the fuel duct 20 extends through the inside of the nozzle body 17 and out of it at its end side. Around the tube exit 20*a*, a plurality of wing-type, air conducting swirl elements 23 are arranged at the flange-type end wall 22 of the nozzle body, said swirl elements 23 being inclined in peripheral direction and tapered to the inner end, as evident from FIG. 3. The mentioned swirl elements 23 define channels 24 by which a circumferential component is imparted to the the radial air inflow. Each of the channels 24 decreases in cross section towards its inner end so that air is increasingly accelerated in each channel 24.

Swirl elements 23 are arranged intermediate the end wall 22 and a plate 25 extending in parallel to said end wall. The end wall of the plate 25 averted from the swirl elements 23 forms the boundary wall of another nozzle chamber which is also fitted with swirl elements 26 mounted at the end side of another plate 27 extending in parallel to plate 25, its swirl elements 26 being designed and arranged like the swirl elements 23 of plate 22.

Air flowing laterally into the nozzle housing 19 and through the compressed air inlet 21 is distributed inside the nozzle housing to flow radially into channels 24 intermediate the swirl elements 23 and into the corresponding channels intermediate swirl elements 26. Due to said swirl elements, a twist, i.e. a circulating movement is imparted to the air.

Plate 25 is of an annular design, its internal border having the shape of an annular blade 29 axially projecting in flow direction and conically tapered towards its end. Also the inner edge of the annular plate 27 is axially deflected in flow direction and forms a conical ring 30 enclosing blade 29 at a radial distance.

Liquid fuel discharged from tube exit 20*a* is seized by the rotating air flow and sprayed onto the inside of blade 29 which, on both its sides, is surrounded by rotating and axially moving air currents separating the fuel off the circular sharp tip of the blade 29 to finely and uniformly distribute it as droplets. Said fuel droplets are mixed with the combustion air to enter, together with it, into the tubular main combustion chamber 15. Due to the twisted injection under high pressure, there are formed in the main combustion chamber 15 annular current rolls in which a part of the mixture flow is recycled and which rotate about the longitudinal axis. An electrode 31 is provided in the main combustion chamber 15 for igniting the mixture.

At the end averted from the atomizer nozzle 17, the main combustion chamber 15 is limited by a ring wall 32 forming an aperture 33 for the discharge of the fuel gases. Spaced from and behind the ring wall 32, there is an end wall 34 limiting the chamber 35 situated behind the main combustion chamber 15. At the peripheral wall of the outside of the main combustion chamber 15, heat exchanger ribs 36 extend as far as to the end wall 34. Between said ribs 36, the combustion gases flow radially out of chamber 35 into the secondary combustion chamber 37 whose one end is limited by filter 12.

From the distribution chamber 14, an annular passage 38 extends to the heat exchanger ribs 36. The engine exhaust gases flow through passage 38 and along ribs 36 to be subsequently blended with the combustion gases to flow in common with them into the secondary combustion chamber 37. From there, the hot gas mixture flows through filter 12 to the outlet piece 13.

The periphery of chamber 35 forms a transverse flow mixer 39 in which the gas currents are intensely mixed.

The compressed air inlet 21 contains a nozzle 40 with a critical flow passage, said nozzle being connected via a switch valve 41 to the compressed air collector 42 of the Diesel engine DM. The driving shaft of the latter drives (directly or via a speed reducer) a blower 43 for feeding the compressed air collector 42.

If valve 41 is open and fuel is pumped into the fuel duct 20, fuel and air reach the atomizer nozzle 17. Due to the marked twist in the atomizer nozzle 17, the flame is stabilized and burns free of carbon black in spite of the understoichiometric air amount. Exhaust gas of the engine gets via inlet 11 and distribution chamber 14 to the space between the heat exchanger ribs 36 in order to cool the wall of the main combustion chamber 14. Upon the mixing of the motor exhaust gas and the combustion gas in the transverse flow mixer 39, the flame burns out in the combustion chamber 37 by means of the residual oxygen contained in the exhaust gas. The gas heated this way flows through the ceramic filter 12 to burn down the carbon black.

Figure 4:
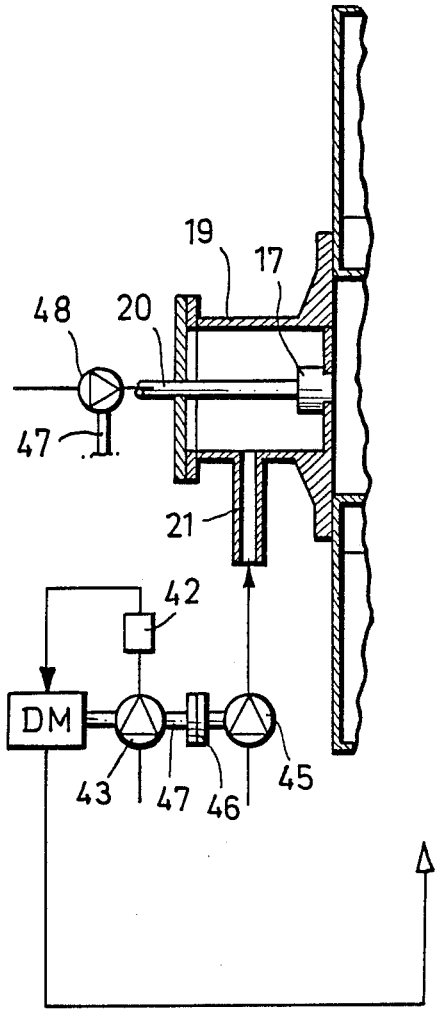
FIG. 4 is another embodiment showing the air supply to the atomizer nozzle.

FIG. 4 shows an embodiment in which compressed air supplied to the atomizer nozzle 17 is generated by a volumetric pump or rotary pump 45. The latter is coupled via a clutch 46 with the driving shaft 47 of the Diesel engine DM (directly or through a gear). The fuel is also supplied to the fuel duct 20 via a rotary pump 48 which is driven by the driven shaft 47 of the Diesel engine. The amounts of compressed air and fuel varying both responsive to the engine speed, while their mutual ratio remains constant, the mixture amount control is speed proportional. Thus, in case of a varying Diesel engine speed, the burner performance is always adapted to the changed exhaust gas amount flow. Therefore, during the regeneration, the temperature at the filter may be substantially kept constant.

What is claimed is:

1. A soot filter for filtering the engine exhaust gas of a Diesel engine, comprising:

an air flow atomizer nozzle having a plurality of swirl elements for producing annular current rolls, supply means for supplying a compulsory, understoichiometric amount of compressed air and fuel in a constant flow to the atomizer nozzle, a primary combustion chamber adjacent the atomizer nozzle for burning a portion of the fuel, whereby the air flow atomizer nozzle produces the annular current rolls in the primary combustion chamber, a secondary combustion chamber adjacent the primary combustion chamber, means for conducting the engine exhaust gas and the unburned portion of the fuel into the secondary combustion chamber for afterburning the fuel to thereby heat the engine exhaust gas, and a filter for filtering the heated exhaust gas to thereby burn down the soot, whereby a flame originating from the nozzle is restricted to the primary combustion chamber and whereby the secondary combustion chamber receives oxygen only in the form of residual oxygen contained in the exhaust gas.

2. A soot filter as set forth in claim 1, further comprising an annular wall confining the primary combustion chamber.

3. A soot filter as set forth in claim 1, further comprising:

a heat exchanger enclosing the primary combustion chamber, the heat exchanger being positioned so that the engine exhaust gas traverses the heat exchanger before reaching the secondary combustion chamber.

4. A soot filter as set forth in claim 1 wherein the unburned portion of the fuel comprises a burner exhaust gas, further comprising:

a transverse flow mixer substantially adjacent the primary combustion chamber, the transverse flow mixer being positioned so that the burner exhaust gas radially traverses the transverse flow mixer and the engine exhaust gas axially traverses the transverse flow mixer.

5. A soot filter as set forth in claim 1, further comprising:

a nozzle for supplying compressed air to the atomizer nozzle.

6. A soot filter as set forth in claim 1, further comprising:

a displacement blower for generating the compressed air.

7. A soot filter as set forth in claim 1, further comprising:

a housing for containing the primary combustion chamber, the secondary combustion chamber and the filter.

8. A device for filtering soot from the engine exhaust gas of a Diesel engine, comprising:

a primary combustion chamber and a secondary combustion chamber, means for combining a compulsory, understoichiometric amount of air and fuel in the primary combustion chamber, including an air flow atomizer nozzle having a plurality of swirl elements for producing annular current rolls in the primary combustion chamber.

means for burning a portion of the fuel in the primary combustion chamber, means for combining the unburned portion of the fuel and the engine exhaust gas in the secondary combustion chamber, means for burning the unburned portion of the fuel in the secondary combustion chamber to thereby heat the engine exhaust gas, and means for filtering the heated exhaust gas to thereby burn down the soot, whereby a flame originating from the nozzle is restricted to the primary combustion chamber and whereby the secondary combustion chamber receives oxygen only in the form of residual oxygen contained in the exhaust gas.

9. A method of filtering soot from the engine exhaust gas of a Diesel engine, comprising the steps of:

combining a compulsory, understoichiometric amount of air and fuel in a primary combustion chamber by an air flow atomizer nozzle having a plurality of swirl elements for producing annular current rolls in the primary combustion chamber, burning a portion of the fuel in the primary combustion chamber, combining the unburned portion of the fuel and the engine exhaust gas in a secondary combustion chamber, burning the unburned portion of the fuel in the secondary combustion chamber to thereby heat the engine exhaust gas, and filtering the heated exhaust gas to thereby burn down the soot, whereby a flame originating from the nozzle is restricted to the primary combustion chamber and whereby the secondary combustion chamber receives oxygen only in the form of residual oxygen contained in the exhaust gas.

* * * * *